219-121
PTH22 XR 4,343,476

United States Patent [19]
Engel et al.
[11] 4,343,476
[45] Aug. 10, 1982

[54] PLAYING PIECE FOR A BOARD GAME

[76] Inventors: Robert W. Engel, 2745 Provincetowne, Toledo, Ohio 43613; John R. Grube, 878 Maple La., Waterville, Ohio 43566

[21] Appl. No.: 163,941

[22] Filed: Jun. 30, 1980

[51] Int. Cl.³ ..... A63F 3/00
[52] U.S. Cl. ..... 273/289
[58] Field of Search ..... 273/288, 289, 290; 401/91, 117

[56] References Cited

U.S. PATENT DOCUMENTS

| | | | |
|---|---|---|---|
| 477,248 | 6/1892 | Davidson | 273/289 |
| 1,399,453 | 12/1921 | Winslow | 273/289 |
| 2,069,462 | 2/1937 | Rouse | 401/117 |
| 2,444,517 | 7/1948 | Levy | 273/289 |
| 3,602,514 | 8/1971 | Peebles | 273/290 |
| 3,888,490 | 6/1975 | Kline | 273/288 |

*Primary Examiner*—Richard C. Pinkham
*Assistant Examiner*—Carl Moy
*Attorney, Agent, or Firm*—Fisher, Gerhardt, Crampton & Groh

[57] ABSTRACT

A playing piece for a board game, such as checkers, or the like, has a base, a stem which is mounted centrally in the base and which has a portion protruding above the base and a sliding jacket that is movable between an upper position surrounding the protruding portion of the stem and a lower position exposing the protruding portion of the stem.

7 Claims, 7 Drawing Figures

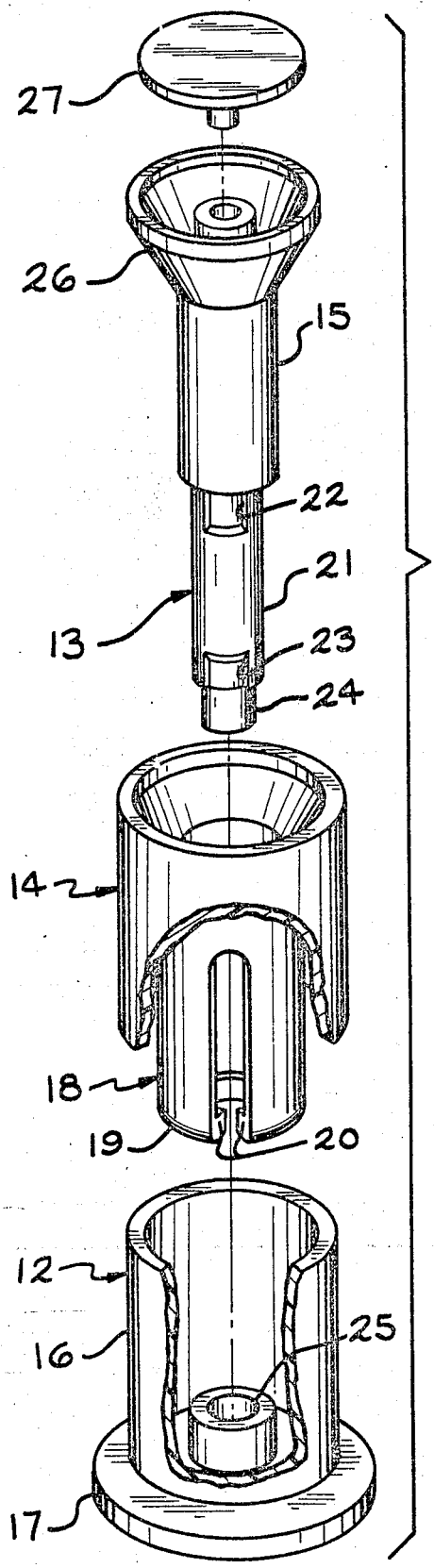
FIG. 4
FIG. 5
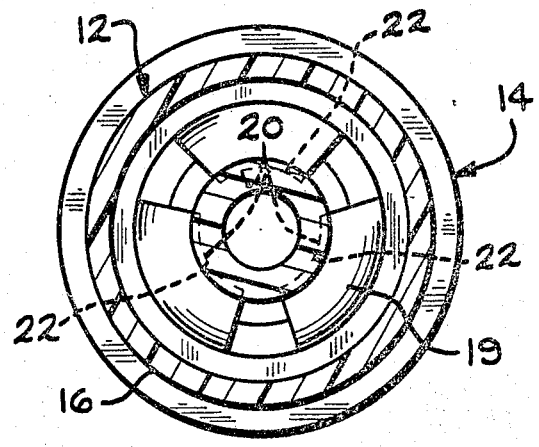
FIG. 7
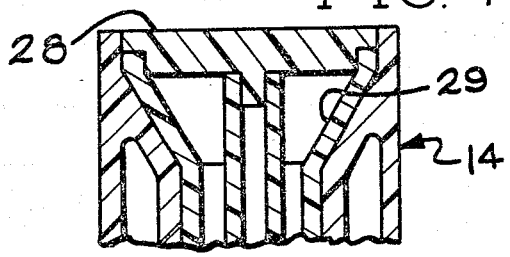
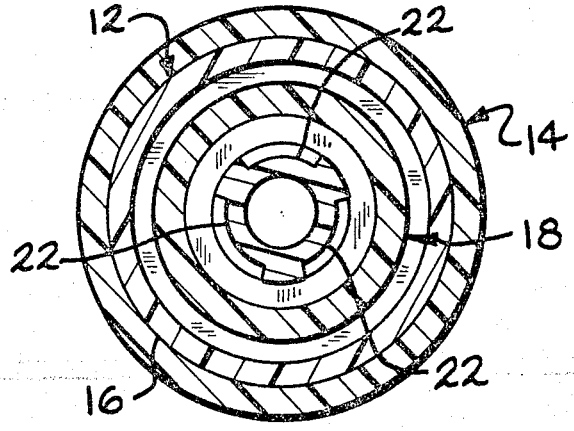
FIG. 6

PLAYING PIECE FOR A BOARD GAME

BACKGROUND OF THE INVENTION

The well known game of checkers is played on a board consisting of sixty-four squares arranged in eight vertical and horizontal rows by two players sitting on opposite sides of the board each of whom has twelve pieces, one set conventionally being black (or red) and the other set being white. Alternating diagonal rows extending across the board are open for play whereas the intervening rows are blocked off. The playing pieces may move only diagonally from square to square although, of course, each piece of each player may "jump" a piece of the other player which is located on an adjacent square and beyond which there is an open square. When a piece is "jumped" it is removed from the board.

If a piece of one player reaches the farthest row from his side of the board, i.e. the first fow of the opponent's side of the board, it becomes a "king" and this change in status is signified by the opponent placing a second piece of the same color called a "crown" on top of the first player's piece. A "king" may move more freely both frontwards and backwards on the diagonal rows and, of course, may jump other pieces.

It is the principal object of the instant invention to provide a playing piece for a board game, such as checkers or the like, or newly devised games playable upon similar boards, which, in itself, possesses the attribute of being readily changed from a normal playing to a "king".

It is yet another object of the instant invention to provide a playing piece which facilitates the devising of variations in the game of checkers or the creation of new board games played upon a similar board, by reason of its design and construction which enables the piece of the invention not only to be a single color playing piece (as a standard checker) but also to be a "king" or yet a third variation which might be called a "wild piece" or "super king", or some other term, depending upon the variation of the game being played and the rules of that game.

BRIEF DESCRIPTION OF THE DRAWINGS

FIG. 4 is an exploded view in perspective, with parts broken away, illustrating how the several parts of a playing piece embodying the invention are configured for assembly to each other;

FIG. 5 is a horizontal sectional view taken along the line 5—5 of FIG. 2 and shown on an enlarged scale;

FIG. 6 is a view similar to FIG. 5 but taken along the line 6—6 of FIG. 3; and

FIG. 7 is a fragmentary, diametric, vertical sectional view of the upper portion of a modified playing piece embodying the invention suitable for utilization, for example, in games which include a piece which might be denominated a "wild king" or "super king".

DESCRIPTION OF PREFERRED EMBODIMENT

Figure 1:
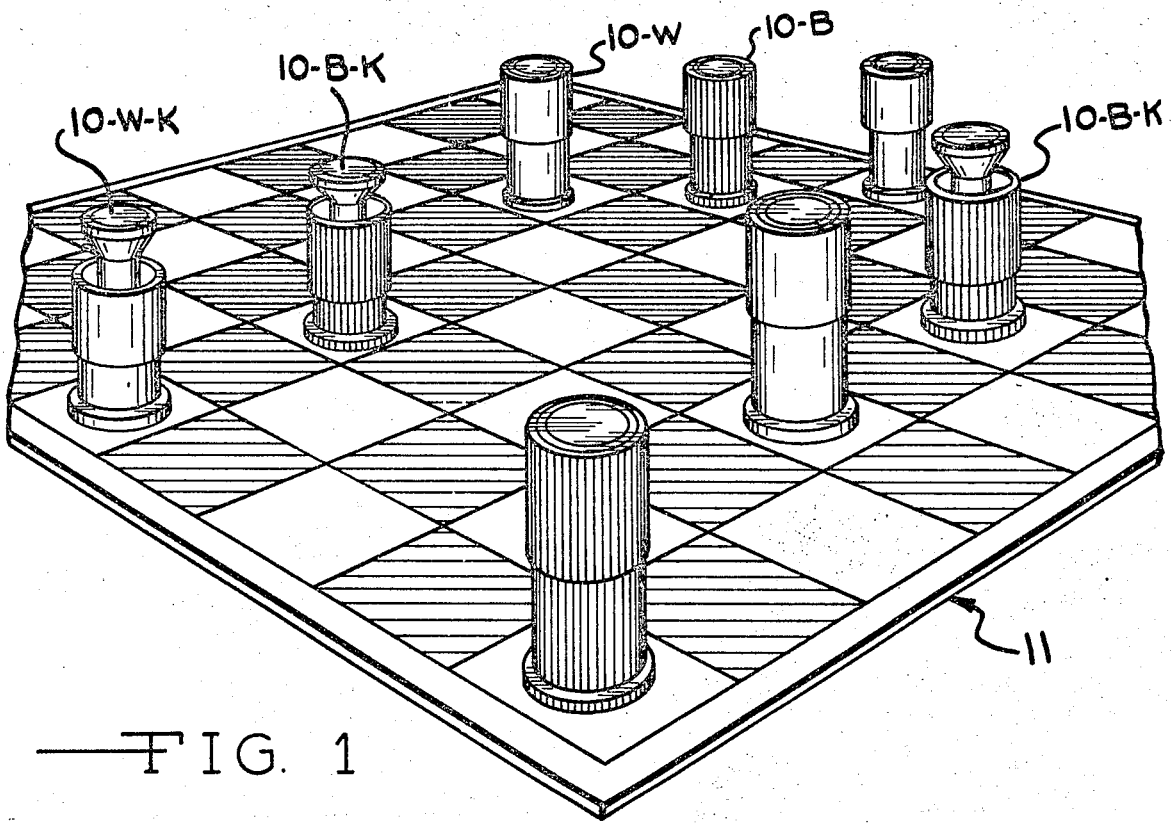
FIG. 1 is a fragmentary view in perspective of a portion of a checker board, or the like, upon which several playing pieces embodying the invention are positioned to illustrate how such pieces can function both as normal pieces, as "kings" or as "super kings"

In FIG. 1 a number of playing pieces embodying the invention as shown and, by the use of more shade lines on their surfaces, some of these playing pieces are indicated as being black, and thus bear the reference numbers 10-B while others are shown as being white and indicated by the reference numbers 10-W. The playing pieces, whether indicated by the reference numbers 10-B or 10-W are identical and are differently shaded simply to illustrate the fact that in the conventional checker game the opponents' pieces are differently colored, usually black and white or red and white. The pieces 10-B and 10-W of FIG. 1 are shown in position on the diagonal playing rows of a conventional checker board, generally indicated by the reference number 11. In addition, in FIG. 1 several of the playing pieces are shown after they have been "kinged", examples being those playing pieces indicated by the reference numbers 10-B-K and 10-W-K, respectively.

Figure 2:
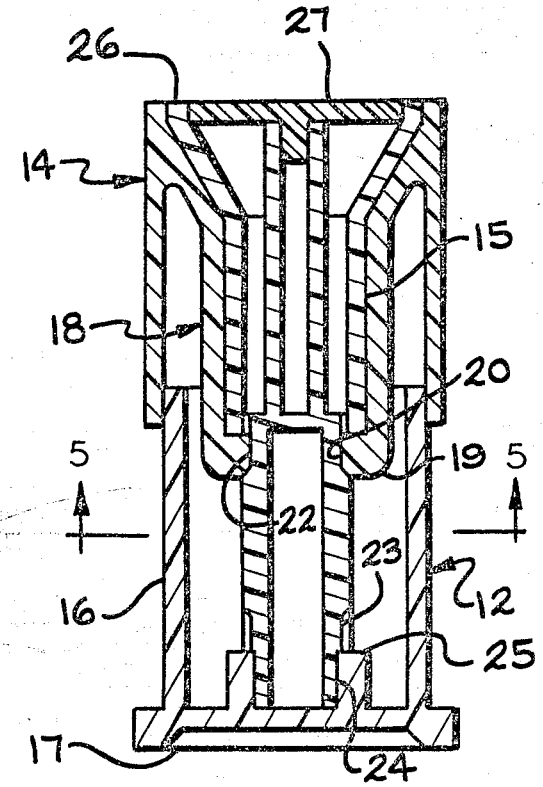
FIG. 2 is a diametric, vertical sectional view of a playing piece embodying the invention with its parts arranged in "normal" position.

Each of the playing pieces 10 consists of three major parts, viz, a base 12, a center stem 13 and a vertically movable jacket 14. As best can be seen by comparing FIGS. 2 and 3 when the parts of a playing piece 10 are assembled, the stem 13 has an upper portion 15 which is surrounded by the sliding jacket 14 in its normal position as illustrated in FIG. 2 and is exposed to view when the jacket 14 is moved downwardly to the position illustrated in FIG. 5 which event occurs when the piece is "kinged".

Figure 3:
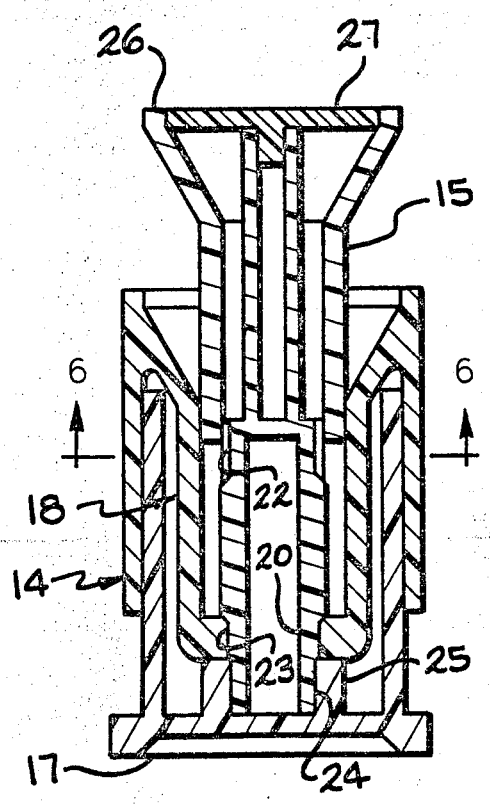
FIG. 3 is a view similar to FIG. 2 but showing a playing piece embodying the invention with its parts arranged in "king" position.

Although colors do not constitute a part of the instant invention, it may be desirable to give a stem 13, or at least its upper portion 15, a color different from either the black or red of one set of pieces or the white of the other set of pieces. For example, the exterior surfaces of the stem 15 might be colored gold or silver so that when the piece is "kinged" as shown in FIG. 3, and indicated by the reference numbers 10-B-K or 10-W-K of FIG. 1, the stem 13 of constrasting color is sharply apparent.

The base 12 has an open top cup-shaped body 16 illustrated as being circular in shape and a bottom 17.

In this embodiment of the invention the jacket 14 has a pair of concentric and spaced depending walls 18 and 19 which are unitarily molded and connected to each other at their respective upper ends. The outer wall 19 has an internal diameter such that it closely embraces the exterior of the base body 16 upon which it slides when moving being the positions illustrated in FIGS. 2 and 3. The inner wall 18 of the jacket 14 is split vertically forming, in this embodiment, three downwardly extending arms at the lower ends of which there are inwardly extending lugs 20. The outside diameter of the inner wall 18 is such that space is provided between it and the inner surface of the base wall 16 for the vertical movement of the inner wall 18 and its lugs 20 between the positions of FIGS. 2 and 3.

The inner apparent diameter of the lugs 20 is such that the lugs 20 frictionally engage and slide on a lower end 21 of the stem 13. This lower portion 21 of the stem 13 has lug receiving recesses 22 and 23 at its upper and lower ends, respectively. As the jacket 14 reaches either the upper position of FIG. 2 or the lower position of FIG. 3, the resiliency of the arms 19 of the inner jacket wall 18 causes the lugs 20 to snap into the recesses 22 or 23 thus giving a positive indication both by feel and audibly that the jacket 14 has reached a limit of its travel and also functioning to retain the jacket 14 at the position to which it has been moved or in which it is desired to be positioned as, for example, at the beginning of a game when all of the jackets 14 of all of the pieces 10 are in normal position shown in FIG. 2.

The stem 13 has a lowermost tenon 24 of such size as to fit tightly into a socket 25 at the center of the upper surface of the base bottom 17.

In assembling the three major portions of a playing piece 10 embodying the invention, it will be seen that the base 12 is placed upon a surface and the jacket 14 slid downwardly with its outer wall 18 circumscribing the body 16 of the base 12. The stem 13 is then moved downwardly through the inner space of the jacket wall 18 until its tenon 24 seats firmly in the socket 25. If desired, of course, some form of adhesive may be employed to permanently secure the stem tenon 24 in the socket 25. However, by suitable selection of the material from which the parts are fabricated, a tight frictional assembly is adequate for retaining the parts in the position illustrated in the drawings.

In the illustrated embodiment the stem 13 has an outwardly flared frusto-conical "crown" 26 at the top of its upper portion 15 and the top of the "crown" 26 may be closed in the embodiment of FIGS. 1–6 by a disc 27. The disc 27 may be colored to correspond to the colors of the respective base 12 and jacket 14 if desired or it may be colored to correspond to the color of the upper portion 15 of the stem 13. In this embodiment, the disc 27 is recessed into the upper end of the stem "crown" 26 thus leaving the uppermost annular lip of the "crown" 26 visible as a ring indicated by the reference number 28 in FIG. 2 even when the jacket 14 is in its upper position surrounding the upper portion 15 and "crown" 26 of the stem 13.

If it is desired to provide a special playing piece, for example one which might be called a "super king" or the like, a top disc 28 (FIG. 7) may be employed with the upper end of a crown 29 cut down a sufficient distance so that when the jacket is in its upper, normal position, as shown in FIG. 7, the color of the crown 29 and thus the upper portion of the stem are hidden from view. A piece embodying the invention as illustrated in FIG. 7 may be included, for example, in each of the players' sets and an opponent would not know which of the pieces is a "super king" because the stem of that piece would be hidden from view. Its stem would have a different color to indicate its "super king" status when its jacket is moved downwardly to expose its stem. It might be that such a "super king" would be permitted to move from one diagonal row transversely to another diagonal row under certain conditions. Such a "super king" might remain hidden to a player's opponent until a time when the particular player saw an advantage to be achieved by exposing his "super king" piece and accomplishing an unusual and, perhaps, devastating move.

Having described our invention, we claim:

1. A playing piece for a board game, said piece comprising: a cup-shaped base adapted to be self-supporting on a horizontal surface and having an open top, a stem connected within and centrally in said base, said stem having an upper head portion protruding upwardly above the open top of said cup-shaped base, and a generally tubular jacket having one end receiving said body and being axially movable between an upper position wherein said head portion of said stem closes one end of said jacket and a lower position exposing the head portion of said stem above said jacket.

2. A playing piece according to claim 1 in which the base body, the stem and the jacket are circular in cross section and are concentric with each other.

3. A playing piece according to claim 1 and cooperating means on the inner wall of the jacket and on the stem for removably retaining said jacket in upper and lower positions thereof.

4. A playing piece according to claim 1 in which the jacket has a resilient inner wall having detent lugs on the inner side thereof and there are detent receiving recesses in the outer surface of the stem into which said detent lugs are adapted to snap at the upper and lower positions of said jacket.

5. A playing piece according to claim 1 in which the stem has an upper end adapted to mount any one of selected identifying elements.

6. A playing piece according to claim 1 in which at least that part of the stem which is exposed when the jacket is in lower position is sharply distinguishable.

7. A playing piece for a board game, said piece comprising: a hollow base having an open top, cup-shaped body, a stem that is mounted interiorly of and centrally in said body, said stem having an upper portion protruding upwardly beyond the margin of said base body, and a sliding jacket embracing said base body and movable thereon between an upper position surrounding the protruding portion of said stem and a lower position exposing the protruding portion of said stem, said jacket having two radially spaced vertical walls, the inner wall slidingly engaging the stem and the outer wall being slidable relative to the exterior of the base body.

* * * * *

4343476 U 27 068
DUBOSE / BOX 711
ACCESSION #49-131
JEANETTE GATLING
2 STAPLES AT BOTTOM
05241515 ZIP:
SEND TO MAILROOM
05/24 TL X985